US009640161B2

(12) United States Patent
Katsuta

(10) Patent No.: US 9,640,161 B2
(45) Date of Patent: May 2, 2017

(54) MUSICAL SCORE DISPLAYING AND PERFORMING PROGRAM, AND MUSICAL SCORE DISPLAYING AND PERFORMING DEVICE

(71) Applicant: KAWAI MUSICAL INSTRUMENTS MANUFACTURING CO., LTD., Hamamatsu-shi, Shizuoka (JP)

(72) Inventor: Masanori Katsuta, Hamamatsu (JP)

(73) Assignee: KAWAI MUSICAL INSTRUMENTS MANUFACTURING CO., LTD., Hamamatsu-shi (JP)

( * ) Notice: Subject to any disclaimer, the term of this patent is extended or adjusted under 35 U.S.C. 154(b) by 0 days.

(21) Appl. No.: 14/915,456

(22) PCT Filed: Jan. 5, 2015

(86) PCT No.: PCT/JP2015/050023
§ 371 (c)(1),
(2) Date: Feb. 29, 2016

(87) PCT Pub. No.: WO2015/146201
PCT Pub. Date: Oct. 1, 2015

(65) Prior Publication Data

US 2016/0300554 A1 Oct. 13, 2016

(30) Foreign Application Priority Data

Mar. 24, 2014 (JP) ..... 2014-059890

(51) Int. Cl.
*G10H 1/00* (2006.01)
*G10G 1/00* (2006.01)

(52) U.S. Cl.
CPC ..... *G10H 1/0033* (2013.01); *G10G 1/00* (2013.01); *G10H 1/00* (2013.01); *G10H 2220/096* (2013.01); *G10H 2220/121* (2013.01)

(58) Field of Classification Search
CPC ..... G10G 1/00
(Continued)

(56) References Cited

U.S. PATENT DOCUMENTS 3,460,425 A * 8/1969 Kiepe ..... G09B 15/04 84/470 R
3,562,394 A * 2/1971 Kiepe ..... G09B 15/04 84/470 R
(Continued)

FOREIGN PATENT DOCUMENTS

JP 9-114453 5/1997
JP 2004-341079 12/2004
(Continued)

OTHER PUBLICATIONS

International Preliminary Examination Report mailed Oct. 6, 2016 for corresponding International Application No. PCT/JP2015/050023, including Eng. Translation, 14pp.
(Continued)

*Primary Examiner* — David Warren
(74) *Attorney, Agent, or Firm* — Lewis Roca Rothgerber Christie LLP

(57) ABSTRACT

The program of the present invention is provided for an information terminal equipped with a touch panel that is used for displaying a musical score thereon, the information terminal performing music in accordance with performance sequence data corresponding to the musical score. The program displays the musical score on the touch panel, determines a start bar for a performance sequence as the start
(Continued)

point for performing from any bar region of the musical score by sliding a touch position in the right direction on the particular bar region, and determines an end bar for the performance sequence as an end point for ending the performance in any bar region of the musical score by sliding the touch position in the left direction on the particular bar region. Thus, the user can intuitively designate a range of performance.

10 Claims, 5 Drawing Sheets

(58) Field of Classification Search
USPC ..... 84/609, 614
See application file for complete search history.

(56) References Cited

U.S. PATENT DOCUMENTS 4,288,537 A * 9/1981 Knetzger ..... A63F 9/0078 273/441
6,143,972 A * 11/2000 Ladyjonsky ..... G09B 15/04 84/470 R
7,019,204 B2 * 3/2006 Terada ..... G06Q 20/382 705/64
7,064,261 B2 * 6/2006 Shao ..... G10G 1/00 84/470 R
7,074,999 B2 * 7/2006 Sitrick ..... G09B 15/023 84/477 R
7,098,392 B2 * 8/2006 Sitrick ..... G09B 15/002 84/477 R
7,906,720 B2 * 3/2011 Delorme ..... G10H 1/342 84/477 R
9,324,243 B2 * 4/2016 Soejima ..... G09B 15/002
2004/0055441 A1 * 3/2004 Katsuta ..... G09B 15/00 84/470 R
2006/0288842 A1 * 12/2006 Sitrick ..... G09B 15/002 84/477 R
2011/0209597 A1 * 9/2011 Usui ..... G10H 1/0008 84/622
2012/0227571 A1 * 9/2012 Sasaki ..... G10G 1/00 84/477 R
2012/0247305 A1 * 10/2012 Katsuta ..... G09B 15/023 84/477 R

FOREIGN PATENT DOCUMENTS

JP 2006-39326 2/2006
JP 2013-200455 10/2013
JP 2015-26069 2/2015

OTHER PUBLICATIONS

International Search Report mailed Mar. 17, 2015 for International Application No. PCT/JP2015/050023, including Eng. Translation, 5pp.
Written Opinion mailed Mar. 17, 2015 for International Application No. PCT/JP2015/050023, 4pp.

* cited by examiner

Fig.5

PERFORMANCE SEQUENCE

| IN ORDER OF PERFORMANCE | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| BAR | A | B | C | D | E | F | G | H | A | B | C | D | E | F | G | H | I | J | K | L | M | N | O | P | A | B | C | D | E | F | G | H |

MUSICAL SCORE DISPLAYING AND PERFORMING PROGRAM, AND MUSICAL SCORE DISPLAYING AND PERFORMING DEVICE

CROSS-REFERENCE TO RELATED APPLICATIONS

This application is a national phase application under 35 U.S.C. §371 of International Application No. PCT/JP2015/050023, filed on Jan. 5, 2015, which claims the benefit of Japan Application Nos. 2014-059890, filed on Mar. 24, 2014, the disclosures of which are incorporated herein by reference in their entirety.

TECHNICAL FIELD

The present invention relates to musical score displaying and performing programs, and relates to a musical score displaying and performing program which is installed in a computer to establish a musical score displaying and performing device and which determines performance sequence bars serving as the start point and the end point of an arbitrary performance section designated when performance of a displayed musical score is executed and to a musical score displaying and performing device in which a program is stored.

BACKGROUND ART

A musical score editing device and musical score editing software in which a computer is utilized to create and edit a musical score by an operation on a screen are known. With this device or software, it is possible to create and edit a musical score by an operation on a screen, to display the created musical score on the screen, to execute automatic performance with a sound source incorporated in a personal computer or an external sound source and to output the musical score as a printed item.

For example, as the musical score editing software in which a computer is utilized to create and edit a musical score by an operation on a screen, Score Maker (trade name of Kawai Musical Instruments Manufacturing Co., Ltd.) is known.

Patent Literature 1 discloses a musical information displaying and editing device in which, on each page of a musical score, the staff notation and other musical information of each part are displayed in multiple rows and in which it is possible to select various types of musical symbols, fonts and the like on the musical score to edit them and to change and update the edited results.

With this device, it is possible to display, together with notes, rests and the like, repeat marks and bar lines that indicate the order of performance, repeat and the like, and it is possible to execute the performance in the order corresponding to the performance order and the indication of the repeat.

For example, as shown in FIG. 4, the order of performance (performance sequence) of bars A to P in a musical score 60 which describes a repeat bar line 61 and D. C. (Da Capo) 62 (returns to the head of the musical score and ends at Fine) is as follows: A, B, C, D, E, F, G, H, A, B, C, D, E, F, G, H, I, J, K, L, M, N, O, P, A, B, C, D, E, F, G and H.

Patent Literature 1 Japanese Published Unexamined Patent Application No. H9-114453

SUMMARY OF INVENTION

Technical Problem

On the musical score displayed on the screen described above, it has been desired to designate a performance range with a simple operation and intuitively.

When practicing a musical instrument while reading a musical score displayed on a screen, in a case where it is desired to confirm the performance of an arbitrary bar section of the musical score, it can be considered that a performance start sequence bar serving as the start point of the performance range is determined, and a performance completion sequence bar serving as the end point of the performance range is determined to execute the performance in the performance sequence bar range.

However, in the musical score of FIG. 4, for example, when a bar C is set as the performance start sequence bar, in a performance sequence (FIG. 5) consisting of 32 bars, it is impossible to distinguish and select the bar C in the first round (the third bar), the bar C in the second round (the eleventh bar) or the bar C in the third round (the twenty-seventh bar).

Specifically, when the bar C in the third round is set as the performance start sequence bar serving as the start point of the performance range, the performance is executed in the order of "C, D, E, F, G and H," whereas when the bar C in the second round is set as the performance start sequence bar, the performance is executed in the order of "C, D, E, F, G, H, I, J, K, L, M, N, O, P, A, B, C, D, E, F, G and H." Furthermore, when the bar C in the first round is the performance start sequence bar, the performance is executed in the order of "C, D, E, F, G, H, A, B, C, D, E, F, G, H, I, J, K, L, M, N, O, P, A, B, C, D, E, F, G and H." Consequently, for example, the bar which is first performed following the bar H differs between the "I" (in the case of the bar C in the second round) and the "A" (in the case of the bar C in the first round). Therefore, it is disadvantageously difficult to designate that the performance is executed in the performance sequence order of the musical score from a bar located part-way through the repeat.

The same is true for the performance completion sequence bar serving as the end point of the performance range, and for example, when the bar F is set as the performance completion sequence bar, it is disadvantageously impossible to designate whether it is the performance in the first round, the performance in the second round or the performance in the third round.

The present invention is made in view of the foregoing circumstances, and an object of the present invention is to provide a musical score displaying and performing program and a musical score displaying and performing program device in which a performance range can be designated with a simple operation and intuitively within a musical score displayed in the musical score displaying and performing device.

An object of the present invention is also to provide a musical score displaying and performing program and a musical score displaying and performing program device in which when the same bar is repeatedly performed, performance sequence bars at the start point and the end point of the bar section repeatedly performed in the second and subsequent rounds can be easily set as the performance start sequence bar and the performance completion sequence bar, respectively.

Solution to Problem

To achieve the above object, the present invention provides a musical score displaying and performing program that causes an information terminal including a touch panel to execute display of musical score data and performance of performance sequence data corresponding thereto, wherein a computer is caused to execute; a function of displaying the musical score data on the touch panel; and a function of determining, when on an arbitrary bar region of the musical score data, a movement of a touch position by a desired tracing operation is detected, that a performance sequence bar corresponding to the bar region is a performance start sequence bar serving as a start point of performance execution.

The second aspect of the invention is the musical score displaying and performing program according to the first aspect, wherein the program causes to execute a function of determining, when on the arbitrary bar region of the musical score data, a movement of the touch position by another desired tracing operation distinguishable from the touch position by the tracing operation is detected, that a performance sequence bar corresponding to the bar region is a performance completion sequence bar serving as an end point of the performance execution.

The third aspect of the invention is the musical score displaying and performing program according to the first aspect, wherein when the movement of the touch position by the tracing is detected is when a movement of the touch position to a right direction is detected.

The fourth aspect of the invention is the musical score displaying and performing program according to the third aspect, wherein the program causes to execute a function of determining, when on the arbitrary bar region of the musical score data, a movement of the touch position to the left direction is detected, that a performance sequence bar corresponding to the bar region is a performance completion sequence bar serving as an end point of the performance execution.

The fifth aspect of the invention is the musical score displaying and performing program according to the third aspect, wherein with respect to musical score data in which the same bar is performed a plurality of times, the program causes to execute a function of determining, when on a bar corresponding to the performance start sequence bar already determined by the detection of the touch position, a further movement of the touch position to the right direction is detected, that the performance sequence bar corresponding to the bar in a second and subsequent rounds is the performance start sequence bar.

The sixth aspect of the invention is the musical score displaying and performing program according to the fourth aspect, wherein with respect to musical score data in which the same bar is performed a plurality of times, the program causes to execute a function of determining, when on a bar corresponding to the performance completion sequence bar already determined by the detection of the touch position, a further movement of the touch position to the left direction is detected, that the performance sequence bar corresponding to the bar in a second and subsequent rounds is the performance completion sequence bar.

The seventh aspect of the invention is the musical score displaying and performing program according to the third aspect, wherein the program causes to execute a function of determining, when a movement of the touch position to the right direction is detected outside the bar region of the musical score data, that a performance sequence head bar is the performance start sequence bar.

The eighth aspect of the invention is the musical score displaying and performing program according to the fourth aspect, wherein the program causes to execute a function of determining, when a movement of the touch position to the left direction is detected outside the bar region of the musical score data, that a performance sequence final bar is the performance completion sequence bar.

The ninth aspect of the invention is the musical score displaying and performing program according to the fifth aspect, wherein the program causes to execute processing for displaying, in a vicinity of the bar region corresponding to the performance start sequence bar, on the touch panel, a performance start symbol and a performance number indicating in which round the performance sequence bar corresponding to the bar region is performed.

The tenth aspect of the invention is the musical score displaying and performing program according to the sixth aspect, wherein the program causes to execute processing for displaying, in a vicinity of the bar region corresponding to the performance completion sequence bar, on the touch panel, a performance completion symbol and a performance number indicating in which round the performance sequence bar corresponding to the bar region is performed.

The eleventh aspect of the invention is a musical score displaying and performing device comprises a musical score data storage unit that stores musical score data; a performance sequence data recording unit that records an order of performance of all performance sequence bars on the musical score data; a touch panel that displays the musical score data and that can select a bar in the musical score data; and a start/completion bar setting unit which determines, when on an arbitrary bar region in the musical score data, a movement of a touch position to the right direction is detected, that the performance sequence bar corresponding to the bar region is a performance start sequence bar serving as a start point of performance execution and which determines, when on the arbitrary bar region in the musical score data, a movement of the touch position to the left direction is detected, that the performance sequence bar corresponding to the bar region is a performance completion sequence bar serving as an end point of the performance execution.

Advantageous Effects of Invention

According to the present invention, when movement of the touch position by the desired tracing operation is detected on the bar region, the performance sequence bar corresponding to the bar region is set as the performance start sequence bar, it is thereby possible to directly designate, on the musical score, the performance start bar only by a difference in the movement track of the touch without preparing another setting means.

According to the second aspect of the invention, when movement of the touch position by another desired tracing operation is detected on the bar region, the performance sequence bar corresponding to the bar region is set as the performance completion sequence bar, it is thereby possible to directly designate, on the musical score, the performance range only by a difference in the movement track of the touch without preparing another setting means.

According to the third aspect of the invention, the performance start sequence bar is designated when a movement of the touch position to the right direction is detected, it is thereby possible to make a setting by the tracing operation in which the user intuitively and easily recognizes the designation of the performance start position.

According to the fourth aspect of the invention, the performance completion sequence bar is designated when a movement of the touch position to the left direction is detected, it is thereby possible to make a setting by the tracing operation in which the user intuitively and easily recognizes the designation of the performance completion position.

According to the fifth aspect of the invention, when on the bar corresponding to the performance start sequence bar already determined by the detection of the touch position, a further movement of the touch position to the right direction is detected, since the performance sequence bar corresponding to the bar in the second and subsequent rounds is determined to be the performance start sequence bar, in the musical score in which the same bar is repeatedly performed a plurality of times, it is also possible to easily set the performance sequence bar also in the second and subsequent rounds as the performance start sequence bar.

According to the sixth aspect of the invention, when on the bar corresponding to the performance completion sequence bar already determined by the detection of the touch position, a further movement of the touch position to the left direction is detected, since the performance sequence bar corresponding to the bar in the second and subsequent rounds is determined to be the performance completion sequence bar, in the musical score in which the same bar is repeatedly performed a plurality of times, it is also possible to easily set the performance sequence bar in the second and subsequent rounds as the performance completion sequence bar.

According to the seventh aspect of the invention, when a movement of the touch position to the right direction is detected outside the bar region, the performance head sequence bar is set as the performance start sequence bar, it is thereby possible to designate the head bar of the musical score as the performance start bar with a simple operation without switching the range of the display of the musical score so as to display the head bar on the screen.

According to the eighth aspect of the invention, when a movement of the touch position to the left direction is detected outside the bar region, the performance final sequence bar is set as the performance completion sequence bar, it is thereby possible to designate the final bar of the musical score as the performance completion bar with a simple operation without switching the range of the display of the musical score so as to display the final bar on the screen.

According to the ninth aspect of the invention, the performance start symbol and the performance number are displayed on the touch panel, it is thereby possible to easily understand in which round the same bar is repeated as the performance start bar.

According to the tenth aspect of the invention, the performance completion symbol and the performance number are displayed on the touch panel, it is thereby possible to easily understand in which round the same bar is repeated as the performance completion bar.

According to the eleventh aspect of the invention, it is possible to obtain a musical score displaying and performing device in which, when a movement of the touch position to the right direction on the bar region is detected, the performance sequence bar corresponding to the bar region is set as the performance start sequence bar, whereas when a movement of the touch position to the left direction on the bar region is detected, the performance sequence bar corresponding to the bar region is set as the performance completion sequence bar, it is thereby possible to designate a performance range with a simple operation and intuitively.

BRIEF DESCRIPTION OF DRAWINGS

FIG. 5 is a performance sequence table showing the performance order of bars in the musical score of FIG. 4.

DESCRIPTION OF EMBODIMENTS

A musical score displaying and performing device of the present invention will be described below with reference to drawings.

In order to execute the display of musical score data and the performance of performance sequence data corresponding thereto, the musical score displaying and performing device is established by installing a musical score displaying and performing program in a known tablet type terminal which includes a CPU, a ROM, a RAM and a hard disk and the like. The tablet type terminal includes: a touch panel which has a display unit that can display a musical score and an input unit to input a touch operation; and a sound output device such as a speaker which reproduces sound.

The CPU of the musical score displaying and performing device executes, according to a predetermined control program (musical score displaying and performing program) installed, various types of processing to control the entire musical score displaying and performing device.

As an example of the use of the musical score displaying and performing device, for example, the musical score displaying and performing device is connected to a digital piano, musical score data recorded in the device is displayed and performance data corresponding to the musical score data is transmitted to the side of the digital piano, with the result that the sound source of the digital piano is sounded to execute demonstration performance. Moreover, a user plays the digital piano while reading a musical score displayed on the musical score displaying and performing device, inputs the results of the performance to the side of the device, compares them with model performance data corresponding to the musical score data displayed on the side of the device and thereby confirms (evaluates) the state of the performance by the user.

Figure 1:
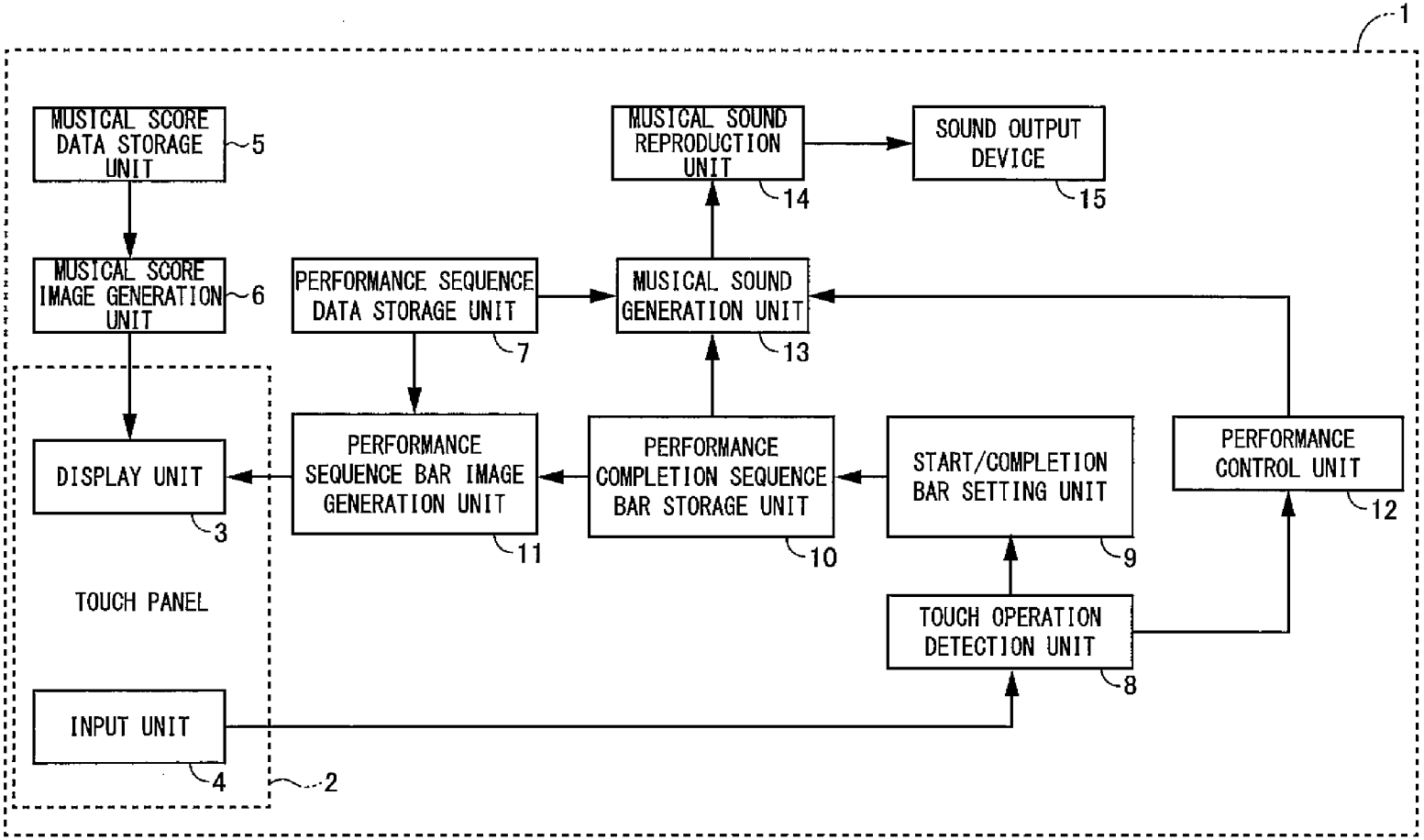
FIG. 1 is a block diagram showing the configuration of a musical score displaying and performing device according to an embodiment of the present invention.

The musical score displaying and performing device that is established by installing, in the tablet type terminal, the musical score displaying and performing program stored in, for example, a recording medium in order to execute the processing according to the present invention will be described with reference to the function block diagram of FIG. 1.

The touch panel 2 included in the musical score displaying and performing device (tablet type terminal) 1 includes the display unit 3 that can display a musical score and the input unit 4 that detects the touch operation within the display unit 3.

In order to display the musical score on the touch panel 2, the musical score displaying and performing device 1 also includes a musical score data storage unit 5 which records the musical score data (image data) displayed on the display unit 3 and a musical score image generation unit 6 which generates a musical score image corresponding to the musical score data.

Figure 4:
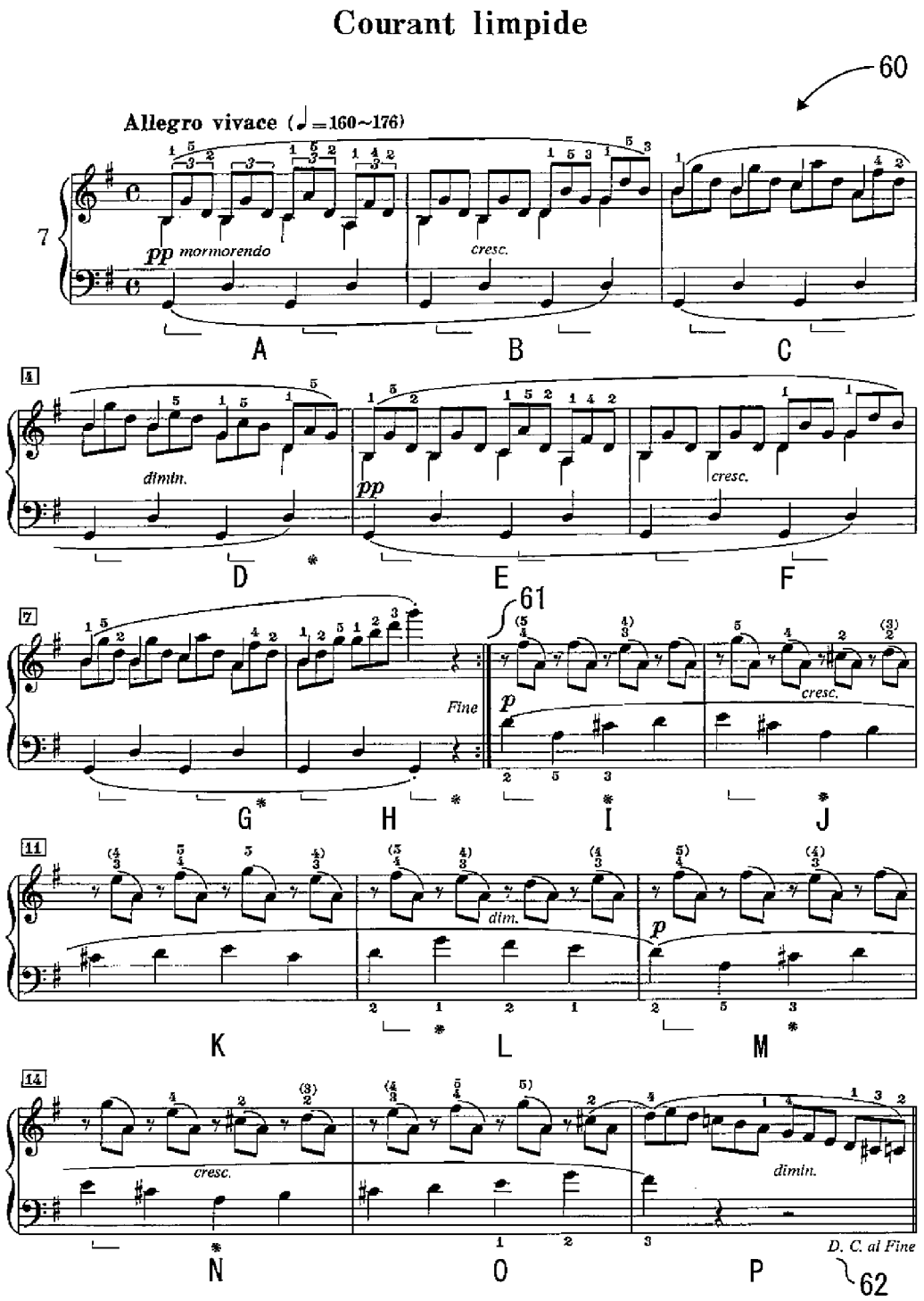
FIG. 4 is a diagram showing an example of a musical score in which the same bar is repeatedly performed.

In the musical score image generation unit 6, the musical score image is generated from the musical score data in the musical score data storage unit 5, and is displayed as a musical score on the touch panel 2 (FIG. 2) of the tablet type terminal 1. For example, when a musical score 60 shown in FIG. 4 is displayed, although part (corresponding to two rows of bars) is displayed on the display unit 3, the user performs a touch operation (swipe operation) in a vertical (up/down) direction, and thus the displayed position of the musical score can be scrolled in the up/down direction.

When the musical score displayed on the display unit 3 of the musical score displaying and performing device 1 is performed, the paragraph of the musical score is displayed by alternately switching the upper row and the lower row according to the progress of the performance. That is, when the bar in the upper row is performed, the paragraph to be performed subsequently is displayed in the lower row, whereas when the bar in the lower row is performed, the paragraph to be performed subsequently is displayed in the upper row.

Furthermore, in order to display a performance start sequence bar and a performance completion sequence bar on the touch panel 2, the musical score displaying and performing device 1 includes: a performance sequence data storage unit 7 which stores performance sequence data (musical sound data) corresponding to the musical score data (image data); a touch operation detection unit 8 which detects the touch operation on the touch panel 2; a start/completion bar setting unit 9 which selects the performance start sequence bar and the performance completion sequence bar by the touch operation; a performance start sequence bar and performance completion sequence bar storage unit 10 which stores the performance start sequence bar and the performance completion sequence bar that are set; and a performance sequence bar image generation unit 11.

The performance sequence data recorded in the performance sequence data storage unit 7 may be stored from an external MIDI device via an MIDI interface (not shown) included in the tablet type terminal.

The input unit 4 of the touch panel 2 is connected to the touch operation detection unit 8, and detects the touch operation which is performed on the display unit 3 of the touch panel 2 by the user. The touch operation detection unit 8 detects, from information on the state of contact input through the input unit 4, the contact manner where a finger of the user touches the screen of the display unit 3.

As the contact manner (touch operation), at least the movement (a tracing operation such as a swipe, a drag or a flick) of a touch position in which the finger is made to slide to the right direction or the left direction while touching the screen of the display unit 3 is included.

That is, when on an arbitrary bar region in the musical score data, a movement of the touch position to the right direction (by a desired tracing operation) is detected, the performance sequence bar corresponding to the bar region is determined to be the performance start sequence bar serving as the start point of the execution of the performance, whereas when on an arbitrary bar region in the musical score data, a movement of the touch position to the left direction (by another desired tracing operation distinguishable from the touch position by the tracing operation described above) is detected, the performance sequence bar corresponding to the bar region is determined to be the performance completion sequence bar serving as the end point of the execution of the performance.

Therefore, since when a movement of the touch position by the desired tracing operation is detected, the performance sequence bar corresponding to the bar region can be set as the performance start sequence bar or the performance completion sequence bar, it is possible to directly designate, on the musical score, the performance start bar or the performance completion bar only by a difference in the movement track of the touch without preparing another setting means.

The performance start sequence bar is designated when a movement of the touch position to the right direction is detected, the performance completion sequence bar is designated when a movement of the touch position to the left direction is detected, it is thereby possible for the user to perform the tracing operation while intuitively recognizing the designation of the performance start position and the performance completion position.

When a movement of the touch position to the right direction is detected outside the bar region 17, a performance sequence head bar in the musical score is determined to be the performance start sequence bar, whereas when a movement of the touch position to the left direction is detected outside the bar region 17, a performance sequence final bar is determined to be the performance completion sequence bar.

Therefore, the performance sequence head bar and the performance sequence final bar can be respectively and easily set as the performance start sequence bar and the performance completion sequence bar without the musical score of the parts thereof being displayed.

In the touch operation described above, a program may be used which is incorporated in the OS of the tablet type terminal in advance and which detects individual operations, that is, a tap (an operation of touching the screen by a finger once within a predetermined time), a double tap (an operation of touching the screen by a finger twice within a predetermined time), a drag (an operation of moving a finger with the finger in contact with the screen), a pinch (an operation of touching the screen simultaneously with two fingers such that the two positions in contact are moved close to or apart from each other), a swipe (an operation of making a finger slide while touching the screen) and a flick (an operation of quickly moving the finger to separate from the screen, such that the finger in contact with the screen wipes the screen). Alternatively, processing for independently detecting an operation of moving the touch position in an up/down direction or in the left/right direction, such as a swipe, may be included in the musical score displaying and performing program.

In the touch operation detection unit 8, when the touch operation is performed on the bar region of the display unit 3, based on position information (for example, coordinate information) received from the input unit 4, the position of the bar within the musical score is identified. In this case, it is preferable that the bar may be intuitively identified based on touch operation start position information, however, not limited thereto, the bar may be identified based on touch operation completion position information or when the touch movement is detected over a plurality of bars between the start and end of the touch operation, a bar which is touched for the longest time may be adopted, etc.

In the performance sequence data storage unit 7, together with performance data on all the performance sequence bars, the bar regions (position coordinates) in the musical score corresponding thereto, the performance order of the performance sequence bars and the like are stored. The start/completion bar setting unit 9 determines, from the touch position detected by the touch operation detection unit 8 and the bar position information stored in the performance sequence data storage unit 7, the performance start sequence bar or the performance completion sequence bar in the musical score displayed on the display unit 3. The performance start sequence bar is the bar that serves as the start point when performance of the musical score displayed on the display unit 3 is executed. The performance completion sequence bar is the final bar when performance of the musical score displayed on the display unit 3 is executed. When the performance is executed with the performance start sequence bar and the performance completion sequence bar set, the performance is executed in the performance range in which the performance start sequence bar is the start point and the performance completion sequence bar is the end point.

Figure 2:
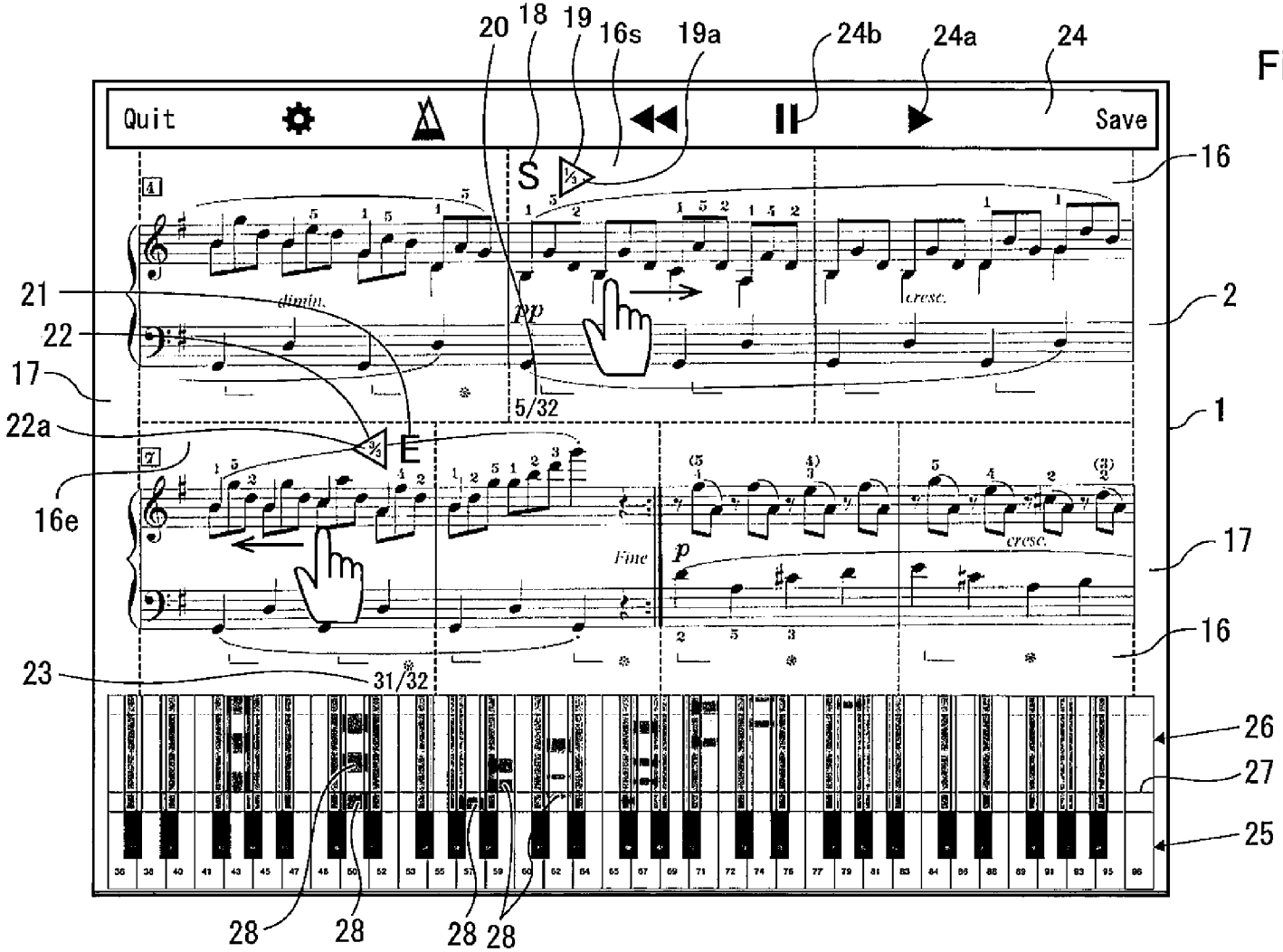
FIG. 2 is an illustrative diagram of a screen displayed on a touch panel by the musical score displaying and performing program of the present invention.

When the performance start sequence bar and the performance completion sequence bar are determined, on the touch panel 2 shown in FIG. 2, in the vicinity of a bar region 16*s* and in the vicinity of a bar region 16*e* corresponding to the performance start sequence bar and the performance completion sequence bar, performance start symbols 18 and 19 which indicate the position of the start of the performance section and performance completion symbols 21 and 22 which indicate the position of the completion of the performance section are displayed.

The performance start symbol 18 is formed with "S" which is the first letter of START, and the performance start symbol 19 is formed with an isosceles triangle having a vertex on the right side. The performance completion symbol 21 is formed with "E" which is the first letter of END, and the performance completion symbol 22 is formed with an isosceles triangle having a vertex on the left side.

Preferably, in the start/completion bar setting unit 9, a restriction is added such that it is not allowed to set the performance completion sequence bar ahead of the performance start sequence bar or that it is not allowed to set the performance start sequence bar behind the performance completion sequence bar. For example, when the performance start sequence bar and the performance completion sequence bar are set, the performance order is individually detected from the data in the performance sequence data storage unit 7, and information indicating that it is impossible to set such a designation that the performance order in the performance sequence bars shown in FIG. 5 is reversed between the start and the completion of the performance is displayed on the display unit 3 or is sounded.

The performance start sequence bar and performance completion sequence bar storage unit 10 records the performance start sequence bar and the performance completion sequence bar determined by the start/completion bar setting unit 9. The performance sequence bar image generation unit 11 generates the image displayed on the display unit 3 as the performance start sequence bar and the performance completion sequence bar from the various data stored in the performance sequence data storage unit 7, and the performance start sequence bar and the performance completion sequence bar recorded in the performance start sequence bar and performance completion sequence bar storage unit 10.

On the display unit 3 of the touch panel 2, as shown in FIG. 2, the image of the performance start symbols 18 and 19, the performance completion symbols 21 and 22, performance numbers 19*a* and 22*a* and performance sequence bar numbers 20 and 23 individually indicating the performance start sequence bar and the performance completion sequence bar generated in the performance sequence bar image generation unit 11 is displayed.

The touch operation detection unit 8 is connected to a performance control unit 12, and the performance control unit 12 provides an instruction to execute desired performance. That is, the touch operation is performed on icons such as performance start 24*a* and performance stop 24*b* within a performance control display unit 24 of the touch panel 2 shown in FIG. 2, and thus the performance execution and the performance stop are selected, with the result that processing such as musical sound reproduction corresponding to the details of the selection is performed by the performance control unit 12.

A musical sound generation unit 13 generates a musical sound based on the data of the performance start sequence bar and the performance completion sequence bar from the performance sequence data storage unit 7 and the performance start sequence bar and performance completion sequence bar storage unit 10, and outputs the musical sound to a musical sound reproduction unit 14. The musical sound reproduction unit 14 includes a sound source for reproducing a musical sound incorporated in the tablet type terminal, outputs a musical sound signal to a sound output device 15 and reproduces the sound.

In a conventional device, in the case of the musical score 60 as shown in FIG. 4 in which the same bar is performed a plurality of times, it is impossible to make such a setting that distinguishes the performance sequence bar (the performance start sequence bar or the performance completion sequence bar) set as the start or the completion corresponds to what number of the performance sequence bar (FIG. 5), however, in the musical score displaying and performing device of the present invention, it is possible to make a setting while distinguishing the above.

That is, under conditions in which the performance start sequence bar and the performance completion sequence bar are already determined by the touch operation, when on the bar region 16*s* corresponding to the performance start sequence bar, a movement of the touch position to the right direction in the second round is detected, the performance sequence bar in the second round corresponding to such a bar is determined to be the performance start sequence bar. Moreover, under conditions in which the performance sequence bar in the second round is set as the performance start sequence bar, when on the bar region 16*s* corresponding to the performance start sequence bar, a movement of the touch position to the right direction in the third round is detected, the performance sequence bar in the third round corresponding to such a bar is determined to be the performance start sequence bar. In a case where the number of times the bar is performed is three, when the touch operation in the fourth round is further detected, since it is impossible to count up the number of times any more, the performance sequence bar in the first round corresponding to such a bar is determined to be the performance start sequence bar.

Similarly, under conditions in which the performance completion sequence bar is already determined by the touch operation, when on the bar region 16*e* corresponding to the performance completion sequence bar, a movement of the touch position to the left direction in the second round is detected, the performance sequence bar in the second round corresponding to such a bar is determined to be the performance completion sequence bar. Moreover, under conditions in which the performance sequence bar in the second round is set as the performance completion sequence bar, when on the bar region 16*e* corresponding to the performance completion sequence bar, a movement of the touch position to the left direction in the third round is detected, the performance sequence bar in the third round corresponding to such a bar is determined to be the performance completion sequence bar. In a case where the number of times the bar is performed is three, when the touch operation in the fourth round is further detected, since it is impossible to count up the number of times any more, the performance sequence bar in the first round corresponding to such a bar is determined to be the performance completion sequence bar.

In the upper left portion of the bar region 16*s* corresponding to the performance start sequence bar, the performance start symbol 18 and the performance number 19*a* indicating in which round the performance sequence bar corresponding to the bar region 16*s* is performed are displayed within the performance start symbol (isosceles triangle having a vertex on the right side) 19. The performance number 19*a* is displayed as a fraction in which the number of times (in this example, in the case of the bar E, 3 times) the bar corresponding to the performance start sequence bar in the musical score 60 (FIG. 4) is performed is a denominator and the number (in this example, in the case of the bar E, 1 to 3 times) of in which round the bar corresponding to the performance start sequence bar is performed is a numerator.

Moreover, in the lower left portion of the bar region 16*s* corresponding to the performance start sequence bar, the performance sequence bar number 20 indicating the number of the performance sequence bar (FIG. 5) when counted from the head of the musical score 60. The performance sequence bar number 20 is displayed as a fraction in which the total number of performance sequence bars in the musical score 60 (in this example, in the case of the musical score 60, 32) is a denominator and the performance start sequence bar number is a numerator.

Similarly, in the upper right portion of the bar region 16*e* corresponding to the performance completion sequence bar, the performance completion symbol 21 and the performance number 22*a* indicating in which round the performance sequence bar corresponding to the bar region 16*e* is performed are displayed within the performance completion symbol (isosceles triangle having a vertex on the left side) 22. The performance number 22*a* is displayed as a fraction in which the number of times (in this example, in the case of the bar G, 3 times) the musical score 60 (FIG. 4) of the bar corresponding to the performance completion sequence bar is performed is a denominator and the number (in this example, in the case of the bar G, 1 to 3 times) of in which round the bar corresponding to the performance completion sequence bar is performed is a numerator.

Moreover, in the lower right portion of the bar region 16*e* corresponding to the performance completion sequence bar, the performance sequence bar number 23 indicating the number of the performance sequence bar (FIG. 5) when counted from the head of the musical score 60. The performance sequence bar number 23 is displayed as a fraction in which the total number of performance sequence bars in the musical score 60 (in this example, in the case of the musical score 60, 32) is a denominator and the performance completion sequence bar number is a numerator.

The reason why the performance start symbols 18 and 19 of the performance start sequence bar and the performance sequence bar number 20 are displayed in the upper and lower positions on the left side of the bar region 16*s* and the performance completion symbols 21 and 22 of the performance completion sequence bar and the performance sequence bar number 23 are displayed in the upper and lower positions on the right side of the bar region 16*e* is that when the performance start bar and the performance completion bar are the same bar, the symbols and the number displays are prevented from being overlapped.

In the case of the touch panel 2 shown in FIG. 2, the performance start symbols 18 and 19 are displayed in the bar region 16*s*, and set in the performance start sequence bar. In the bar region 16*s*, the performance number 19*a* is displayed as "1/3," and the performance sequence bar number 20 is displayed as "5/32." This indicates that the bar E (the bar region 16*s*) of the performance start sequence determined is the fifth bar of the performance order in the musical score 60 of FIG. 4 and is the performance of the bar E in the first round.

The performance completion symbols 21 and 22 are displayed in the bar region 16*e*, and set in the performance completion sequence bar. In the bar region 16*e*, the performance number 22*a* is displayed as "3/3," and the performance sequence bar number 23 is displayed as "31/32." This indicates that the bar G (the bar region 16*e*) of the performance completion sequence determined is the thirty-first bar of the performance order in the musical score 60 of FIG. 4 and is the performance of the bar G in the third round.

Therefore, when in this state, the performance start 24*a* of the performance control display unit 24 is touched to execute the performance, the performance is executed in the order of "E, F, G, H, A, B, C, D, E, F, G, H, I, J, K, L, M, N, O, P, A, B, C, D, E, F and G."

On the bar region 16*s* corresponding to the performance start sequence bar and the bar region 16*e* corresponding to the performance completion sequence bar, processing for displaying by changing the color tone with the performance number described above, it is thereby possible to visually understand in which round (in the case of FIG. 2, the performance start sequence bar is in the first round, and the performance completion sequence bar is in the third round) the bar is applicable to the performance sequence bar in the musical score 60.

In the touch panel 2, in the lower position of the musical score, a performance timing information display unit is provided on which performance timing information on the notes shown in the musical score 60 is displayed. The performance timing information display unit is formed with a keyboard display unit 25, a timing display unit 26 in which the vertical direction is a time axis and a sound emission reference line 27, and in the timing display unit 26, in the upper position of the keyboard display unit 25 corresponding to the pitch of the respective notes of the musical score 60, a rectangular sound emission mark 28 is displayed.

The keyboard display unit 25 is formed with an image of a piano keyboard, and configured to emit a desired sound corresponding to the position of the keyboard when the corresponding keyboard is touched.

In the timing display unit 26, the vertical direction is the time axis, and the sound emission mark 28 corresponding to an approximate one bar can be displayed. The sound emission mark 28 includes information on the length of the note (in a long note, its rectangular up/down direction is prolonged), and is moved from the upward to the downward direction of the timing display unit 26 synchronously with the performance, and sound emission is performed with timing at which the sound emission reference line 27 is passed.

When in a state where the selected performance sequence bar is determined, the icon of the performance start 24*a* of the performance control display unit 24 is selected, the sound emission mark 28 displayed on the performance timing information display unit is displayed synchronously with the execution of the performance in which the selected performance sequence bar is the start point.

By providing the performance timing information display unit, in the case of the musical score in which the same bar is performed a plurality of times, the performance timing of the performance sequence data for each round of the performance can be confirmed on the musical score displayed on the touch panel 2.

Figure 3:
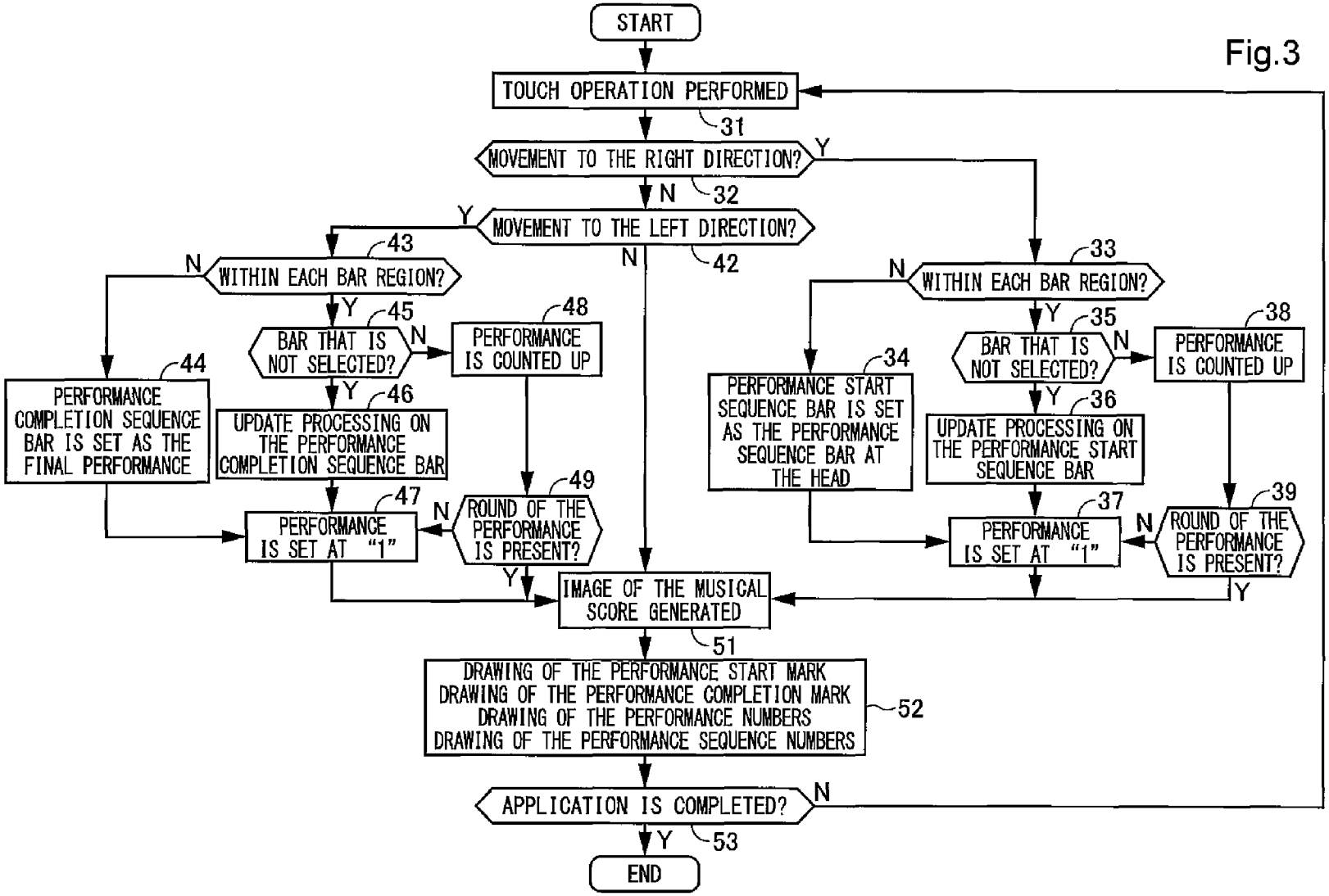
FIG. 3 is a flowchart showing a processing procedure for image generation by the musical score displaying and performing program of the present invention.

A procedure for detecting, when the touch operation is performed by the user on the input unit 4 of the touch panel 2, the touch operation with the touch operation detection unit 8 and generating, with the performance sequence bar image generation unit 11, the image of the performance start symbols 18 and 19 corresponding to the performance start sequence bar and the performance completion sequence bar, the performance completion symbols 21 and 22, the performance numbers 19*a* and 22*a* and the performance sequence bar numbers 20 and 23 will be described with reference to the flowchart of FIG. 3.

The touch operation performed by the user on the input unit 4 is first detected by the touch operation detection unit 8 (step 31).

Then, whether the touch operation is the movement to the right direction of the touch position is determined (step 32).

When the touch operation is the movement to the right direction of the touch position, whether or not the touch operation is within each bar region in the musical score displayed on the touch panel 2 is determined (step 33).

When the touch operation is outside the bar region, the performance start sequence bar is set as the performance sequence bar at the head of the musical score (step 34), and thereafter the round of the performance is set at "1" (step 37).

When the touch operation is within the bar region, whether or not the detected touch operation is a bar that is not selected is determined (step 35).

When the detected touch operation is a bar that is not selected, update processing on the performance start sequence bar is performed (step 36), and the round of the performance is set at "1" (step 37).

In this case, the performance start sequence bar is the performance sequence bar that is performed in the first round on the bar repeatedly performed in the musical score 60.

When the bar on which the touch operation is performed in step 35 is not a bar that is not selected, the round of the performance is counted up (step 38), and whether or not the round of the performance is present is determined (step 39).

When the round of the performance is not present (that is, in the example of the bar F of FIG. 4, when the round of the performance is counted up to 4, the round of the performance is not present), the round of the performance is set at "1" (step 37). After step 37 and Y is selected in step 39, the image of the musical score generated in the musical score image generation unit 6 is drawn (step 51).

For example, when the round of the performance counted up in step 38 is "2," the performance start sequence bar is the performance sequence bar that is performed in the second round on the bar repeatedly performed in the musical score 60.

When the touch operation in step 32 is not the movement to the right direction of the touch position, whether or not the touch operation is the movement to the left direction of the touch position is determined (step 42).

When the touch operation in step 42 is the movement to the left direction of the touch position, whether or not the touch operation is within each bar region in the musical score displayed on the touch panel 2 is determined (step 43).

When the touch operation is outside the bar region, the performance completion sequence bar is set as the final performance sequence bar in the musical score (step 44), and thereafter the round of the performance is set at "1" (step 47).

When the touch operation is within the bar region, whether or not the detected touch operation is a bar that is not selected is determined (step 45).

When the detected touch operation is a bar that is not selected, update processing on the performance completion sequence bar is performed (step 46), and the round of the performance is set at "1" (step 47).

In this case, the performance completion sequence bar is the performance sequence bar that is performed in the first round on the bar repeatedly performed in the musical score 60.

When the bar on which the touch operation is performed in step 45 is not a bar that is not selected, the round of the performance is counted up (step 48), and whether or not the round of the performance is already present is determined (step 49).

When the round of the performance is not present, the round of the performance is set at "1" (step 47).

After step 47 and Y is selected in step 49, the image of the musical score generated in the musical score image generation unit 6 is drawn (step 51).

For example, when the round of the performance counted up in step 38 is "2," the performance start sequence bar is the performance sequence bar that is performed in the second round on the bar repeatedly performed in the musical score 60.

When in step 42, the touch operation is not the movement in the left direction, the image of the musical score generated in the musical score image generation unit 6 is drawn (step 51).

In the performance sequence bar image generation unit 11, the drawing to determine a color for display from the bar-selected state in which round the performance start sequence bar or the performance completion sequence bar is the performance sequence bar and the drawing of the performance start symbol 18, the performance completion symbol 21, the performance numbers 19*a* and 22*a* and the performance sequence bar numbers 20 and 23, which are displayed within the bar region, are performed (step 52).

Then, the drawing of the performance start symbols 18 and 19, the performance completion symbols 21 and 22, the performance numbers 19*a* and 22*a* and the performance sequence bar numbers 20 and 23 generated in the performance sequence bar image generation unit 11 is performed, and the images are displayed on the display unit 3 of the touch panel 2 (step 52).

Whether or not the application is completed is determined (step 53), and when it is not completed, the process is returned to step 31 where the processing is continued.

According to the musical score displaying and performing device (the musical score displaying and performing program) described above, when a movement of the touch position to the right direction on the bar region is detected, the performance sequence bar corresponding to the bar region is set as the performance start sequence bar, whereas when a movement of the touch position to the left direction on the bar region is detected, the performance sequence bar corresponding to the bar region is set as the performance completion sequence bar, it is thereby possible to designate a performance range with a simple operation and intuitively.

Since when on the bar corresponding to the performance start sequence bar or the performance completion sequence bar already determined by the touch operation, a further movement of the touch position to the left/right direction is detected, the performance sequence bar corresponding to such a bar in the second and subsequent rounds is determined to be the performance start sequence bar or the performance completion sequence bar, on the performance sequence bar (the bar in which a plurality of rounds of the performance are present) in the second and subsequent rounds in the musical score 60 in which the same bar is repeatedly performed a plurality of times, it is also possible to easily set the performance start sequence bar or the performance completion sequence bar while understanding the order of the performance.

Therefore, when in the musical score displaying and performing device, the musical score in which the same bar is performed a plurality of times is displayed, it is possible to set the round of the performance in the performance start sequence bar or the performance completion sequence bar only with a simple touch operation.

The number of times the start bar and the completion bar are performed in the performance range can be confirmed on the musical score displayed on the touch panel 2.

That is, when the performance start sequence bar and the performance completion sequence bar are set, since it is possible to distinguish in which round the performance is executed and to make a setting, it is possible to easily designate the performance range including the bar repeatedly performed within the musical score 60; when the performance is desired to be executed in a range from the bar E performed in the first round to the bar G performed in the third round, as shown in FIG. 2, the bar E is set as the performance start sequence bar (the first round), and the bar G is set as the performance completion sequence bar (the third round), it is thereby possible to execute the performance in the performance order of "E, F, G, H, A, B, C, D, E, F, G, H, I, J, K, L, M, N, O, P, A, B, C, D, E, F and G"

Although the example discussed above is described under the assumption of the detection of a movement of the touch position to the right direction or to the left direction by swipe as the touch operation, when the performance start sequence bar and the performance completion sequence bar are set, a movement of the touch position by a predetermined desired "tracing" operation in the display unit 3 through another method may be detected.

In the "tracing" operation, for example, the performance start may be designated by swipe in the downward direction, and the performance completion may be designated by swipe in the upward direction. As the touch operation by gesture, the performance start may be designated by a parentheses opening "(" and the performance completion may be designated by a parentheses closing ")."

In short, it suffices to indicate the performance start and the performance completion by desired separate touch operations (distinguishable "tracing" operations), and at that time, the direction component of the movement of the touch, the pass shape of the gesture and the like are set by the start designation and the completion designation so as to be symmetrical (the movements in the left/right direction, the movements in the up/down direction and the opening and closing of the parentheses), it is thereby possible to understand them intuitively and easily. Alternatively, when the designation is performed by gesture, it can also be considered that the performance start and the performance completion are designated by performing the touch operation so as to write, in a single stroke, on the bar region, the letter "s" or "e."

REFERENCE SIGNS LIST

1 . . . musical score displaying and performing device, 2 . . . touch panel, 3 . . . display unit, 4 . . . input unit, 5 . . . musical score data storage unit, 6 . . . musical score image generation unit, 7 . . . performance sequence data storage unit, 8 . . . touch operation detection unit, 9 . . . start/completion bar setting unit, 10 . . . performance completion sequence bar storage unit, 11 . . . performance sequence bar image generation unit, 12 . . . performance control unit, 18, 19 . . . performance start symbol, 19*a* . . . performance number, 20 . . . performance sequence bar number, 21, 22 . . . performance completion symbol, 22*a* . . . performance number, 23 . . . performance sequence bar number, 24 . . . performance control display unit, 25 . . . keyboard display unit, 26 . . . timing display unit, 27 . . . sound emission reference line, 28 . . . rectangular sound emission mark, 60 . . . musical score

The invention claimed is:

1. A musical score displaying and performing program being stored on a non-transitory computer-readable medium and when executed by an information terminal including a touch panel, causes said information terminal to perform a process comprising:

displaying musical score data on the touch panel; and when on a first arbitrary bar region of the displayed musical score data, a first movement of a touch position by a first tracing operation is detected, determining that a first performance sequence bar corresponding to the first arbitrary bar region is a performance start sequence bar activating a start point of performance of performance sequence data corresponding to the displayed musical score data;

when on a second arbitrary bar region of the displayed musical score data a second movement of the touch position by a second tracing operation is detected, determining that a second performance sequence bar corresponding to the second arbitrary bar region is a performance completion sequence bar activating an end point of performance of performance sequence data corresponding to the displayed musical score data;

determining a performance range between the start point of performance and the end point of performance;

determining whether there is a repeat bar and a number of times that the repeat bar is to be performed within the determined performance range; and performing the performance sequence data including the repeat bar according the number of times that the repeat bar is to be performed, within the determined performance range.

2. The musical score displaying and performing program according to claim 1, wherein when the movement of the touch position by the tracing operation is detected is when a movement of the touch position to a right direction is detected.

3. The musical score displaying and performing program according to claim 2, wherein the program when executed further determines the end point of performance, when on the second arbitrary bar region of the displayed musical score data, a movement of the touch position to the left direction is detected.

4. The musical score displaying and performing program according to claim 2, wherein with respect to musical score data in which the same bar is performed a plurality of times, the program when executed further determines the start point of performance, when on a bar corresponding to the performance start sequence bar already determined by the detection of the touch position, a further movement of the touch position to the right direction is detected.

5. The musical score displaying and performing program according to claim 3, wherein with respect to musical score data in which the same bar is performed a plurality of times, the program when executed further determines, when on a bar corresponding to the performance completion sequence bar already determined by the detection of the touch position, a further movement of the touch position to the left direction is detected, that the performance sequence bar corresponding to the bar in a second and subsequent rounds is the performance completion sequence bar.

6. The musical score displaying and performing program according to claim 2, wherein the program when executed further determines, when a movement of the touch position to the right direction is detected outside the first arbitrary bar region of the displayed musical score data, that a performance sequence head bar is the performance start sequence bar.

7. The musical score displaying and performing program according to claim 3, wherein the program when executed further determines, when a movement of the touch position to the left direction is detected outside the second arbitrary bar region of the musical score data, that a performance sequence final bar is the performance completion sequence bar.

8. The musical score displaying and performing program according to claim 4, wherein the program when executed further displays, in a vicinity of the first arbitrary bar region corresponding to the performance start sequence bar, on the touch panel, a performance start symbol and a performance number indicating in which round the performance sequence bar corresponding to the first arbitrary bar region is performed.

9. The musical score displaying and performing program according to claim 5, wherein the program when executed further displays, in a vicinity of the second arbitrary bar region corresponding to the performance completion sequence bar, on the touch panel, a performance completion symbol and a performance number indicating in which round the performance sequence bar corresponding to the second arbitrary bar region is performed.

10. A musical score displaying and performing device comprising:

a musical score data storage unit that stores musical score data;

a performance sequence data recording unit that records an order of performance of all performance sequence bars on the musical score data;

a touch panel that displays the musical score data and capable of selecting a bar in the displayed musical score data; and a start/completion bar setting unit which determines, when on a first arbitrary bar region in the displayed musical score data, a first movement of a touch position is detected, that a first performance sequence bar corresponding to the first arbitrary bar region is a performance start sequence bar activating a start point of performance execution; determines, when on the first arbitrary bar region in the displayed musical score data, a second movement of the touch position is detected, that a first performance sequence bar corresponding to a second arbitrary bar region is a performance completion sequence bar activating an end point of the performance execution; determines a performance range between the start point of performance and the end point of performance; determines whether there is a repeat bar and a number of times that the repeat bar is to be performed within the determined performance range; and performs the performance sequence data including the repeat bar according the number of times that the repeat bar is to be performed, within the determined performance range.

* * * * *